US005755640A

United States Patent [19]

Frolov et al.

[11] Patent Number: 5,755,640

[45] Date of Patent: May 26, 1998

[54] ENDOGENIC BREATHING TRAINER

[76] Inventors: Vladimir F. Frolov, Apt. 355, Birylovskay St. No. 947/1, Moscow, 111360, Russian Federation; Eugene F. Kustov, Ap. 270, Krasniy Kazanets St. No. 19/1, Moscow, 111395, Russian Federation

[21] Appl. No.: 760,423

[22] Filed: Dec. 4, 1996

[51] Int. Cl.[6] ..... A63B 23/18

[52] U.S. Cl. ..... 482/13

[58] Field of Search ..... 482/13

[56] References Cited

U.S. PATENT DOCUMENTS

| | | | |
|---|---|---|---|
| 1,044,367 | 11/1912 | Evans | 482/13 |
| 3,455,294 | 7/1969 | Adler et al. | 482/13 |
| 3,972,326 | 8/1976 | Brawn | 482/13 |
| 4,010,946 | 3/1977 | Miller | 482/13 |
| 4,096,855 | 6/1978 | Fleury, Jr. | 482/13 |
| 4,114,616 | 9/1978 | Brawn | 482/13 |

FOREIGN PATENT DOCUMENTS 1790417 1/1993 U.S.S.R. .

*Primary Examiner*—Lynne A. Reichard
*Attorney, Agent, or Firm*—Pollock, Vande Sande & Priddy

[57] ABSTRACT

An endogenic breathing trainer including an inner chamber including an upper end and a lower end. The lower end includes a plurality of holes formed therethrough for permitting air to enter and exit the inner chamber. A breathing pipe connected to the upper end of the inner chamber permits air to enter and exit the inner chamber. A middle chamber receives the inner chamber. The middle chamber includes an upper end and a lower end. The upper end includes a passage therethrough for receiving the breathing pipe and at least one inlet permitting air to pass into the middle chamber. The lower end of the inner chamber is separated from the lower end of the middle chamber by a gap filled with water. An outer chamber receives the inner chamber and the middle chamber. The outer chamber includes an upper end and a lower end. The upper end of the outer chamber includes a passage therethrough for receiving the breathing pipe. At least one inlet passage in the outer chamber permits air to enter and exit the outer chamber. At least one removable insert adjusts an inner volume of the outer chamber. The at least one removable insert includes at least one body engaging the outer chamber and decreases the volume of air that may enter the outer chamber through the at least one inlet passage.

11 Claims, 1 Drawing Sheet

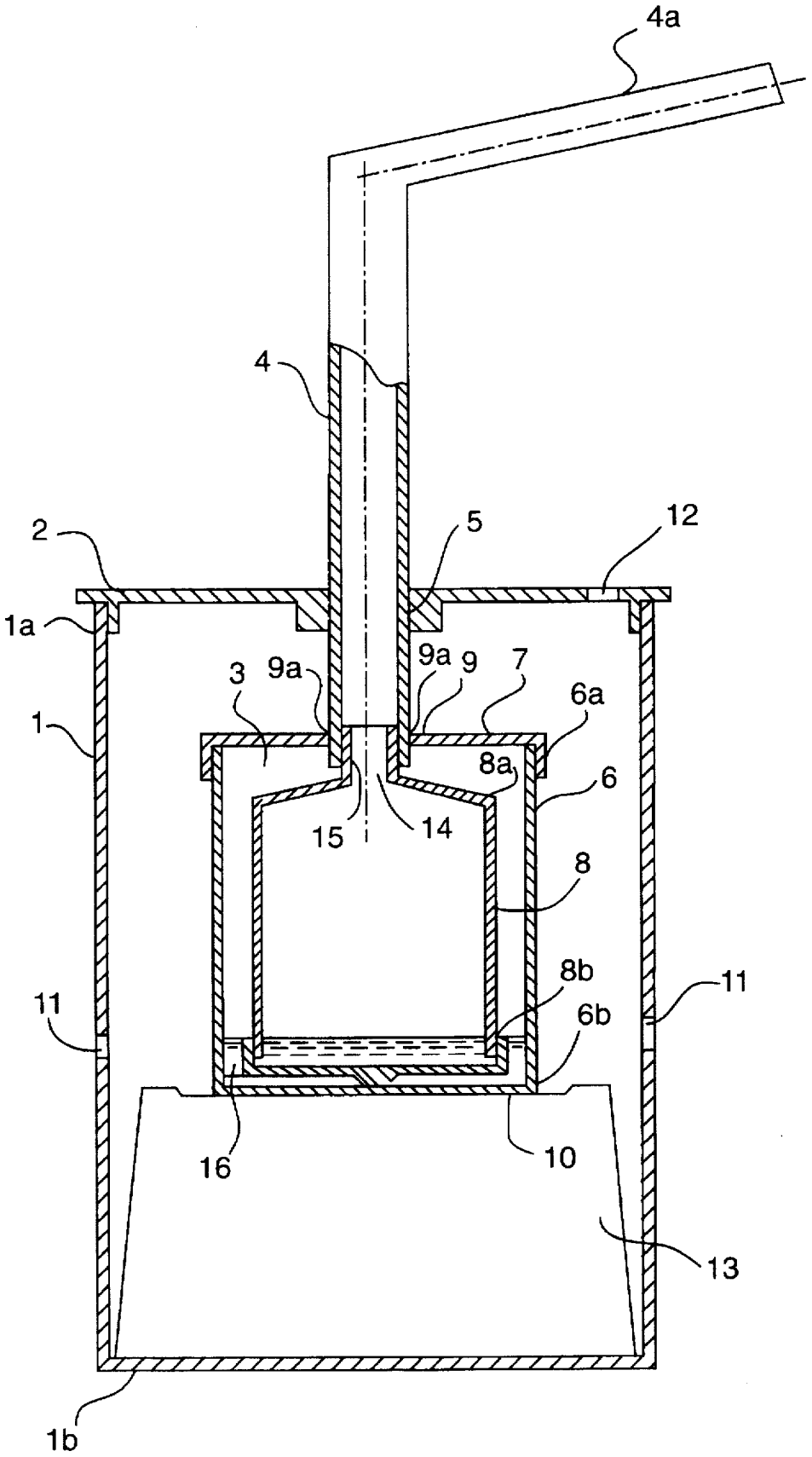
4a
4
2
5
12
1a
3
9a
9a
9
7
6a
1
8a
6
15
14
8
8b
11
11
6b
16
10
13
1b

ENDOGENIC BREATHING TRAINER

FIELD OF THE INVENTION

The present invention relates to the field of breathing trainers. More particularly, the present invention relates to a breathing trainer for encouraging a person to breath endogenically.

BACKGROUND OF THE INVENTION

The endogenic breathing trainer according to the present invention is based on the phenomenon of endogenic breathing and ensures a high level of energetic and biochemical cellular exchange with a simnultaneous decrease of free radicals and peroxides.

SUMMARY OF THE INVENTION

The present invention is designed for to be used as medical inhaler and sport breath trainer in a regimen of breathing resistance.

According to preferred aspects, the present invention provides an endogenic breathing trainer including an inner chamber including an upper end and a lower end. The lower end includes a plurality of holes formed therethrough for permitting air to enter and exit the inner chamber. A breathing pipe connected to the upper end of the inner chamber permits air to enter and exit the inner chamber. A middle chamber receives the inner chamber. The middle chamber includes an upper end and a lower end. The upper end includes a passage therethrough for receiving the breathing pipe and at least one inlet permitting air to pass into the middle chamber. The lower end of the inner chamber is separated from the lower end of the middle chamber by a gap filled with water. An outer chamber receives the inner chamber and the middle chamber. The outer chamber includes an upper end and a lower end. The upper end of the outer chamber includes a passage therethrough for receiving the breathing pipe. At least one inlet passage in the outer chamber permits air to enter and exit the outer chamber. At least one removable insert adjusts an inner volume of the outer chamber. The at least one removable insert includes at least one body engaging the outer chamber and decreases the volume of air that may enter the outer chamber through the at least one inlet passage.

According to other preferred aspects, the present invention provides a method of treating and prophylaxis of ischemic heart disease, hypertension, hypotension, cerebral blood exchange, bronchial asthma, chronic bronchitis, osteochondrosis, ulcers, impotency, cancer, insultus, and infarction, in a patient; protecting a person from radiation and polluted air; extending human life; fighting aging in people; protecting a person from high blood pressure while working under water, hypodynamia, imponderance, and the effects of stress; to enhance elasticity and cleaning of blood channels; to prevent cerebral thrombosis; to increase immune and adaptive response of people; for breathing training and improvement of sportive achievements; to increase the oxidation of free radicals; and to increase the number of cells in a patient's body supply their own oxygen, energy, and substance exchange requirements.

The method includes providing an endogenic breathing trainer, including an inner chamber including an upper end and a lower end, the lower end including a plurality of holes formed therethrough for permitting air to enter and exit the inner chamber. The breathing trainers also includes a breathing pipe connected to the upper end of the inner chamber for permitting air to enter and exit the inner chamber. A middle chamber receives the inner chamber and includes an upper end and a lower end. The upper end includes a passage therethrough for receiving the breathing pipe and at least one inlet for permitting air to pass into the middle chamber. The lower end of the inner chamber is separated from the lower end of the middle chamber by a gap filled with water. The breathing trainer also includes an outer chamber for receiving the inner chamber and the middle chamber. The outer chamber includes an upper end and a lower end, the upper end including a passage therethrough for receiving the breathing pipe. At least one inlet in the outer chamber permits air to enter the outer charter. Further, the breathing trainer includes at least one removable insert for adjusting an inner volume of the outer chamber. The at least one removable insert includes at least one body engaging the outer chamber and decreasing the volume of air that may enter the outer chamber through the at least one inlet.

The method also includes placing the lips of the patient about the breathing pipe. The patient inhales, thereby causing air to flow through the at least one inlet in the outer chamber, the at least one inlet in the middle chamber, the middle chamber, the water in the gap between the middle chamber and the outer chamber, the inner chamber, and the breathing pipe, and into the lungs of the patient. The patient then exhales to cause air to flow out of the patient's lungs, through the breathing pipe, the inner chamber, the water in the gap between the middle chamber and the outer chamber, the middle chamber, the at least one inlet in the middle chamber, the outer chamber, and the at least one inlet in the outer chamber. The patient repeats inhalation and exhalation a desired number of times.

Still other objects and advantages of the present invention will become readily apparent to those skilled in this art from the following detailed description, where it is shown and described only the preferred embodiments of the invention, simply by way of illustration with the best mode contemplated of carrying out She invent-on. As will be realized, the invention is capable of other and different embodiments, and its several details are capable of modifications in various respects, without departing from the invention. Accordingly, the drawings and description are to be regarded as illustrative in nature and not as restrictive.

BRIEF DESCRIPTION OF THE DRAWINGS

FIG. 1 presents a cross-sectional view of an embodiment of an endogenic breathing trainer according to the present invention.

DETAILED DESCRIPTION OF THE INVENTION

The endogenic breathing trainer according to the present invention is based on the phenomenon of endogenic or internal breathing and insures a high level of energetic and biochemical cellular exchange with a simultaneous decrease of free radicals by 3–5 times and peroxides by 2–4 times.

The present invention is designed so as to be useful as medical inhaler and sport breath trainer in a regimen of breathing resistance. As described in greater detail below, according to the breathing regimen, water and/or other liquid, such as a medical treatment substance, preferably is poured into the middle chamber of the endogenic breathing trainer prior to exercise. Inhalation and exhalation are then carried cut through the device. The present invention may also be utilized in the course of breathing under hypercapnia and hypoxia.

An endogenic breathing trainer according to the present invention is different from other types of inhalers because the present invention contains extra capacity scoping the vessel of the endogenic breathing trainer. Additionally, an endogenic breathing trainer according to the present invention has an inlet with a clearance or gap for a breathing pipe.

As shown in FIG. 1, an endogenic breathing trainer according to the present invention preferably includes an outer chamber 1. The outer chamber includes an upper end 1*a* and a lower end 1*b*. In the embodiment shown in FIG. 1, the outer chamber includes a single unitary member.

The outer chamber may have any desired cross-sectional shape. For example, the outer chamber may have a substantially circular cross-sectional shape. Alternatively, the outer chamber may have a square or rectangular cross-sectional shape.

The outer chamber may be made of plastic, metal, or any other desired material that may be suitable for an application such as the present invention.

The upper end 1*a* of the outer chamber 1 may be covered by a lid 2, as in the embodiment shown in FIG. 1. Preferably, the joint between the upper end 1*a* of the outer chamber 1 and the lid 2 is tight, so as to prevent the passage of air between the upper end 1*a* of the outer chamber 1 and the lid 2.

The lid member 2 preferably includes a passage 5 for receiving a breathing pipe 4 described below in greater detail. Preferably, the passage 5 is large enough to permit the breathing pipe 4 to pass therethrough while substantially sealing the space between the wall of the passage 5 and the breathing pipe 4. The lid may also include a sealing member, such as a rubber gasket, about the opening of the passage 5 so as to seal the space between the inlet 5 and the breathing pipe 4.

The upper end 1*a* of the outer chamber 1 may also include at least one passage 12 permitting air to flow into and out of the outer passage when the present invention is in use. For example, the lid member 2 in the embodiment shown in FIG. 1 may include at least one passage 12. The at least one passage 12 may be located anywhere in the upper end or lid of the outer chamber. For example, the at least one passage may be continuous with the passage 5 for receiving the breathing pipe. Alternatively or additionally, the at least one passage 12 may be located elsewhere in the upper end or lid 2. The upper end or lid may include any number of passages 12.

The method of use of the present invention, in which the function of the inlets will become more clear is described below in greater detail.

The outer chamber may also include at least one passage 11 in the side walls of the outer chamber for permitting air to enter into and exit the outer chamber while the present invention is in use. The embodiment shown in FIG. 1 includes two such passages in the side wall of the outer chamber 1.

Including passage(s) 12 in the top of the outer chamber may decrease the amount of $CO_2$ in the apparatus. On the other hand, including passage(s) 11 in the side of the outer chamber may increase the amount of $CO_2$ in the apparatus.

The present invention also preferably includes a middle chamber 6 located within the outer chamber 1. The inner chamber 6 includes an upper end 6*a* and a lower end 6*b*. As with the outer chamber 1, the middle chamber 6 may have a variety of cross-sectional shapes, including those described above. The middle chamber may also be made of a variety of materials, including those discussed above. The middle chamber has a smaller cross-sectional area than the outer chamber 1 thereby permitting the middle chamber 6 to be inserted into the outer chamber 1.

The upper end 6*a* of the middle chamber 6 may be closed with a lid member 7. Preferably, the lid member 7 tightly engages the upper end 6*a* of the middle chamber 6 so as to prevent the passage of air between the lid member and the middle chamber 6. The device may also include a seal, such as a rubber gasket, to seal the space between the lid member 7 and the middle chamber 6.

The lid member 7 preferably includes a passage 9 for receiving breathing pipe 4. The passage 9 may substantially entirely surround the entire cuter surface of the breathing pipe 4.

The middle chamber 6 preferably also includes at least one passage for permitting the air to pass between the outer chamber and the middle chamber. The at least one passage may be continuous with the passage 9 for receiving the breathing pipe 4. Such embodiment is shown in FIG. 1 that includes two passages 9*a* continuous with the passage 9 for receiving the breathing pipe 4.

Alternatively, the at least one passage providing a connection between the outer and middle chambers may be located elsewhere in the lid member 7 of the middle chamber 6. Still further, the at least one passage providing the connection between the middle and outer chambers may be provided in a side wall of the middle chamber 6. According to such an embodiment, the at least one passage will be provided above the water present in the bottom of the middle passage as described below.

The present invention preferably also includes an inner chamber 8. The inner chamber 8 includes an upper end 8*a* and a lower end 8*b*. The upper end 8*a* includes a passage 14 for receiving the breathing pipe 4 in the embodiment shown in FIG. 1, the inner chamber 8 includes a connection 15 for engaging the breathing pipe 4. The shape and materials of the inner chamber 8 may be similar to those described above for the middle and outer chambers.

Preferably, the connection between the breathing pipe 4 and the inner chamber 8 is substantially air tight. The bottom end 8*b* of the inner chamber 8 preferably includes at least one orifice 10 formed in the vicinity of the bottom end 8*b* of the inner chamber. The embodiment shown in FIG. 1 includes a plurality of orifices formed in the bottom of the inner chamber 6. The orifices preferably permit gas and liquid to penetrate into the inner chamber 8 when the present invention is in use, as described in greater detail below.

When in use, the inner chamber preferably is provided with water and/or other liquid, such as a medical treatment substance 16. Preferably, enough water is provided so as to permit the bottom end of the inner chamber 8 to be immersed in the water while a gap remains between the bottom surface of the inner chamber 8 and the inner bottom surface of the middle chamber 6. According to one embodiment, one inch of water is provided in the middle chamber.

The effective volume of the outer chamber may be varied by placing at least one removable volume adjusting insert 13 into the inner chamber. The at least one volume removable adjusting insert 13 preferably reduces the amount of air that may enter the outer chamber through the orifices 11 and/or 7 and may increase the pressure in the outer chamber.

The at least one volume reducing insert 13 may engage an inner surface of the outer chamber 1. In the embodiment shown in FIG. 1, the at least one volume reducing insert 13 engages the lower inner surface of the outer chamber 1. The at least one removable volume reducing insert 13 may also engage the inner side surfaces of the outer chamber 1.

The at least one volume reducing insert 13 may be a solid or hollow body. Also, the at least one removable volume reducing insert 13 may have a continuous outer surface. Alternatively, the at least one volume reducing insert 13 may include an inverted cup-like structure as in the embodiment shown in FIG. 1.

The at least one volume reducing insert 13 does not necessarily have to provide a sealed space by engaging an inner surface of the outer chamber 1. For example, the at least one volume reducing insert 13 could be a body having a continuous outer surface and could include one or more legs or arms for engaging the inner surface of the outer chamber. Such an embodiment would still reduce the inner volume of the outer chamber that may be filled with air entering the outer chamber through passages 11 and/or 7.

Additional volume reducing inserts could be provided in the outer chamber. For example, another insert similar in shape to the one shown in FIG. 1 could be placed on top of the insert shown in FIG. 1. The additional insert could be smaller and be stacked upon the insert shown in FIG. 1. Alternatively, the volume reducing capacity of the insert shown in FIG. 1 could be altered by increasing or decreasing its size.

The middle chamber 6 may rest upon the at least one volume reducing insert 13 as in the embodiment shown in FIG. 1.

The present invention, including the at least one volume reducing insert provides improved results as compared other breathing trainers that include outer chambers that include multiple parts or partitions. The present invention is simpler so as to be easier to assemble and use. The present invention is also more air tight as compared to other trainers since no joints are present in the outer chamber. Also, there may be only one joint between the outer chamber and the volume reducing insert. Alternatively, the volume reducing insert could be a solid body and, therefore, eliminate entirely any joint. The present invention may also provide a higher degree of saturation of the air and more carbon dioxide in the chamber(s). All of these enhancements provide better treatment and training effect.

According to one embodiment, the outer chamber is a cylindrical box, about 76 mm wide, and about 140 mm tall. In this embodiment, the height of the device, from the base of the outer chamber to the top of the mouthpiece is about 280 mm.

The endogenic breathing trainer according to the present invention may be utilized for treatment and prophylaxis of ischemic heart disease, hypertension, hypotension, cerebral blood exchange, bronchial asthma, chronic bronchitis, osteochondrosis, ulcers, impotency, cancer, insultus, and infarction in a patient. The endogenic breathing trainer according to the present invention may be utilized for protecting a person from radiation and polluted air, extending human life, fighting aging in people, protecting a person from high blood pressure while working under water, hypodynamia, imponderance, and the effects of stress; to enhance elasticity and cleaning of blood channels. Furthermore, the endogenic breathing trainer according to the present invention may be utilized for preventing cerebral thrombosis, to increase immune and adaptive response of people, for breathing training and improvement of sportive achievements, to increase the oxidation of free radicals, and to increase the number of cells in a patient's body supply their own oxygen, energy, and substance exchange requirements.

The present invention helps to produce maximally efficient functioning of human beings by increasing the oxidation of free radicals of membrane lipids in more cells of organs and tissues. In other words, the present invention causes more cells in a human to supply their own needs in terms of oxygen, energy, and substance exchange. The present invention produces mechanical and chemical conditions for these reactions.

In this disclosure, there is shown and described only the preferred embodiments of the invention. However, as aforementioned, the invention is capable of use in various other combinations and environments and is capable of changes or modifications within the scope of the inventive concept as expressed herein.

We claim:

1. An endogenic breathing trainer, comprising:

an inner chamber including an upper end and a lower end, said lower end including a plurality of holes formed therethrough for permitting air to enter and exit said inner chamber;

a breathing pipe connected to said upper end of said inner chamber for permitting air to enter and exit said inner chamber;

a middle chamber for receiving said inner chamber, said middle chamber including an upper end and a lower end, said upper end including a passage therethrough for receiving said breathing pipe and at least one inlet permitting air to pass into said middle chamber, said lower end of said inner chamber being separated from said lower end of said middle chamber by a gap filled with water;

an outer chamber for receiving said inner chamber and said middle chamber, said outer chamber including an upper end and a lower end, said upper end of said outer chamber including a passage therethrough for receiving said breathing pipe;

at least one inlet passage in said outer chamber for permitting air to enter said outer chamber; and at least one removable insert for adjusting an inner volume of said outer chamber, said at least one removable insert comprising at least one body engaging said outer chamber and decreasing the volume of air that may enter the outer chamber through said at least one inlet passage.

2. An endogenic breathing trainer according to claim 1, wherein said outer chamber includes at least one inlet in said upper end.

3. An endogenic breathing trainer according to claim 1, wherein said outer chamber includes and at least one inlet in a side wall of said outer chamber.

4. An endogenic breathing trainer according to claim 1, wherein said middle chamber includes at least one inlet in said upper end.

5. An endogenic breathing trainer according to claim 1, wherein said middle chamber includes and at least one inlet in a side wall of said middle chamber.

6. An endogenic breathing trainer according to claim 1, further comprising a mouthpiece connected to said breathing pipe.

7. An endogenic breathing trainer according to claim 1, wherein said at least one removable insert comprises an inverted cup-like body that engages the bottom end of the outer chamber, thereby forming a seal for preventing air entering the outer chamber from entering the cup-like body.

8. An endogenic breathing trainer according to claim 1, wherein said outer chamber includes at least one inlet in said upper end and at least one inlet in a side wall of said outer chamber.

9. An endogenic breathing trainer according to claim 1, wherein said upper end of said outer chamber is closed by a lid member.

10. An endogenic breathing trainer according to claim 1, wherein said upper end of said middle chamber is closed by a lid member.

11. An endogenic breathing trainer according to claim 1, wherein said lower end of said outer chamber is closed by a lid member.

* * * * *